US006637960B2

(12) United States Patent
Garcia et al.

(10) Patent No.: US 6,637,960 B2
(45) Date of Patent: Oct. 28, 2003

(54) VACUUM HOLDDOWN DEVICE FOR HARDCOPY APPARATUS

(75) Inventors: Jesus Garcia, Terrassa Barcelona (ES); David Claramunt, Sant Esteve ses Rovires Barcelona (ES); Francisco Javier Perez, Sant Cugat del Valles (ES); Xavier Gros, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 28 days.

(21) Appl. No.: 09/984,932

(22) Filed: Oct. 31, 2001

(65) Prior Publication Data

US 2003/0081979 A1 May 1, 2003

(51) Int. Cl.[7] ..... B41J 11/02
(52) U.S. Cl. ..... 400/648; 400/23
(58) Field of Search ..... 400/23, 24, 29, 400/48, 648, 656, 635; 271/276

(56) References Cited

U.S. PATENT DOCUMENTS 6,454,259 B1 * 9/2002 Madsen et al. ..... 271/276
2002/0110400 A1 * 8/2002 Beehler et al. ..... 400/635

FOREIGN PATENT DOCUMENTS

EP 165377 A * 12/1985 ..... B31F/1/28
JP 09001896 A * 1/1997 ..... B41J/29/377
JP 09216750 A * 8/1997 ..... B65H/5/22

* cited by examiner

*Primary Examiner*—Daniel J. Colilla

(57) ABSTRACT

A vacuum holddown device for a hardcopy apparatus, comprising a printing platen with a pattern of through holes and an underlying vacuum chamber, further comprises a member located therebetween and having a substantially similar pattern of through holes, the member being moveable to align the pattern of holes or not so as to respectively interconnect or disconnect the holes in the printing platen and the vacuum chamber. The member may itself define a secondary chamber with which the holes in the printing platen are in communication when not in communication with the vacuum chamber.

26 Claims, 3 Drawing Sheets

VACUUM HOLDDOWN DEVICE FOR HARDCOPY APPARATUS

FIELD OF THE INVENTION

The present invention relates to a vacuum holddown device for hardcopy apparatus and in particular to a vacuum mechanism for a printer which permits a change between a higher vacuum during a print phase and a lower vacuum or no vacuum during a print media advance phase.

BACKGROUND OF THE INVENTION

The vacuum in the printzone of a printer needs to be applied during printing to hold the print media in the correct position and at the correct spacing under the printhead. This also serves to reduce expansion of the print media as it absorbs ink (i.e. cockle) and ensures a good print quality. On the other hand, the vacuum needs to be removed or substantially reduced while the print media is being advanced in order to reduce friction and to keep the required media positioning accuracy.

During the time the vacuum is rising and falling between its high and low values, the printer is idle, since the vacuum is too high to advance the media, but too low to permit satisfactory printing. Thus the problem arises of how to switch the vacuum in the printzone on and off in the minimum possible time so that it does not adversely affect printing time and thus the throughput of the printer.

In one previous proposal, a fan is used to produce a vacuum in a chamber below a printzone with a plurality of holes in a printing platen between the chamber and the print media. The vacuum pressure can be changed by switching the fan off and on to pressurise and depressurise the chamber. However, this has the disadvantage of taking a long time to change between maximum and minimum pressure levels, typically of the order of tenths of seconds.

In another previous proposal, two vacuum accumulation chambers are provided, one at a high level and the other at a low vacuum level, and a valve is provided to switch the connection of the main vacuum chamber under the printzone to one or the other of the accumulation chambers. The time taken to pressurise and depressurise the main vacuum chamber depends on the relative size of the chambers and also the power used to generate the vacuum. An efficient arrangement has a high power requirement and the volume of each of the vacuum accumulation chambers needs to be at least one order of magnitude larger than that of the main vacuum chamber, leading to high space requirements.

SUMMARY OF THE INVENTION

Certain aspects of the present invention seek to overcome or reduce one or more of the above problems.

The present invention seeks to provide a vacuum holddown arrangement which is simple, compact, efficient and inexpensive.

According to a first aspect of the present invention there is provided a vacuum holddown device for a hardcopy apparatus comprising a printing platen, said printing platen having holes therethrough, said holes being arranged in a predetermined pattern, a vacuum chamber, and a moveable member, said moveable member including a planar portion, said planar portion having holes therethrough arranged in substantially the same predetermined pattern, and said moveable member being moveable between a first position, in which said holes in said moveable member are substantially in alignment with said holes in said printing platen and said holes in said printing platen are in communication with said vacuum chamber, and a second position, in which said holes in said moveable member are out of alignment with said holes in said printing platen and said holes in said printing platen are not in communication with said vacuum chamber.

According to a second aspect of the present invention there is provided a vacuum holddown device for hardcopy apparatus comprising a printing platen having a set of through holes in a predetermined pattern, a moveable member having a set of through holes in substantially the same pattern, and a vacuum chamber, the moveable member being located between said printing platen and said vacuum chamber.

According to a third aspect of the present invention there is provided a method of applying two different pressure levels to a printing platen of a vacuum holddown device of a hardcopy apparatus, said platen having a first set of through holes located to be in communication with a vacuum chamber, the method comprising providing a moveable member between said platen and said vacuum chamber, said moveable member having a second set of through holes, the holes in said first and second sets being arranged in substantially the same pattern, and the method further comprising moving said moveable member between a first position and a second position, said holes in said two sets being in substantial alignment in said first position wherein said first set of holes is in communication with said vacuum chamber, and said holes in said two sets being out of alignment in said second position wherein said first set of holes is not in communication with said vacuum chamber.

BRIEF DESCRIPTION OF THE DRAWINGS

A preferred embodiment of the present invention will now be described, by way of example only, with reference to the accompanying drawings, of which.

It will be appreciated that the drawings are intended for the purpose of explanation and are not to scale.

DETAILED DESCRIPTION OF THE PREFERRED EMBODIMENT

Figure 1:
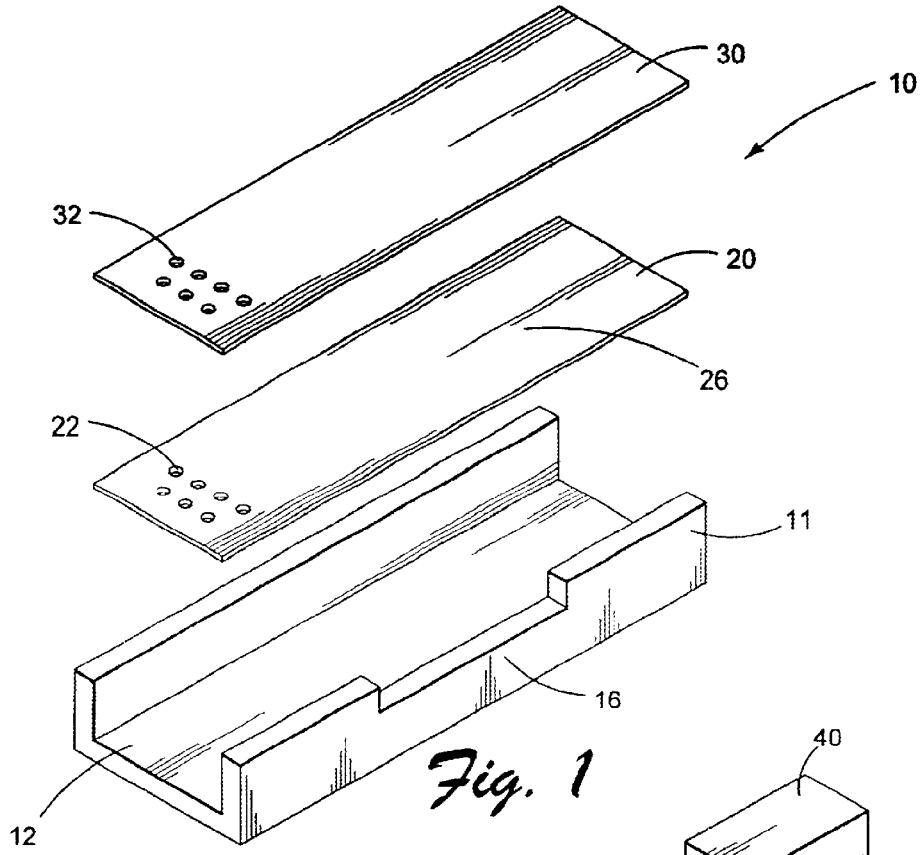
FIG. 1 shows an exploded perspective view of the components of a holddown device in accordance with the present invention.

Referring to the drawings, FIG. 1 shows a general perspective view of a vacuum holddown device 10 in accordance with the present invention. A generally U-shaped channel member 11 defines a main vacuum chamber 12 of the device. In practice, one end of chamber 12 is closed and a high vacuum source 35 is connected to the other end. A valve plate 20, of sheet metal material, is slidably located in a guide groove 14, FIG. 2, extending adjacent to the top of the walls of the U-shaped channel member 11. A printzone platen 30 is secured to the top of the walls allowing the valve plate 20 to slide between the vacuum chamber 12 and the platen 30. The upper surface of the platen 30 is provided with surface grooves serving to ensure equal pressure distribution. The platen 30 and valve plate 20 have matching patterns of through holes 32, 22 therein, and valve plate 20 is slideable between a first position shown in FIG. 3, in which the holes 32, 22 are aligned and a second position shown in FIG. 4, in which the holes 32, 22 are not aligned. To assist explanation, both plate 20 and platen 30 are shown in full lines in FIGS. 3 and 4.

Figure 2:
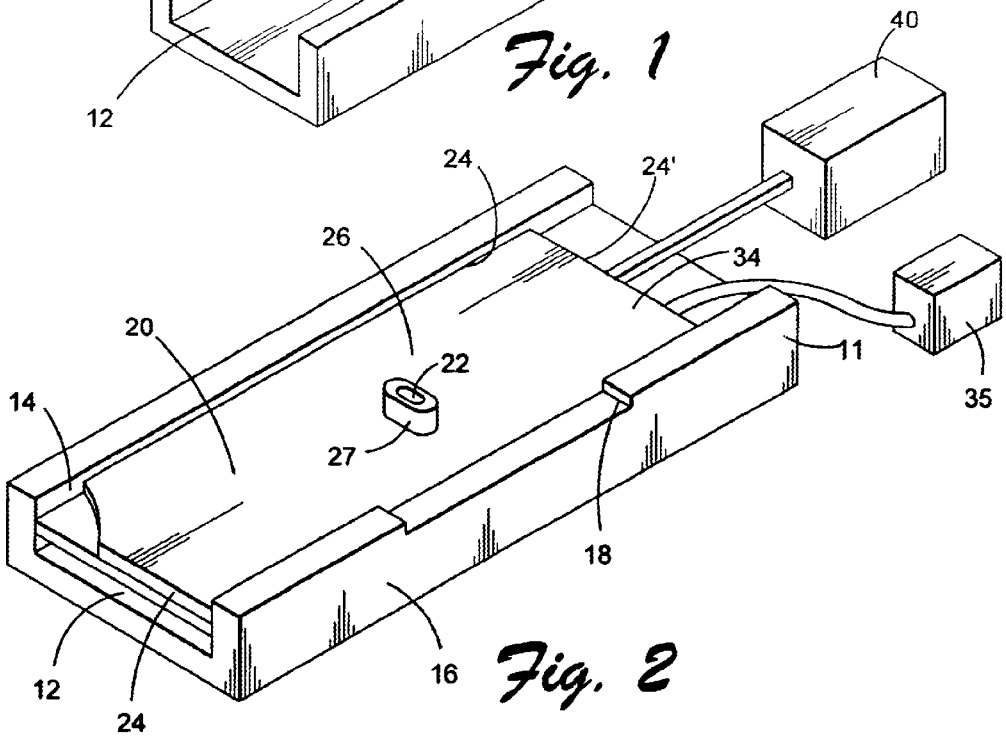
FIG. 2 shows an enlarged schematic prospective view of the device of FIG. 1, with the platen plate omitted for reasons of clarity.

Although component 20 is referred to as a vacuum plate, FIG. 2 shows that it has a peripheral wall 24 so that it resembles a shallow tray around a planar portion 26 of the component 20 defining a major surface thereof. The top surface of wall 24 slides directly against the underside of platen 30 so that a secondary vacuum chamber 34 is formed between the platen 30 and the planar portion 26 of the vacuum plate 20. It will be noted that chamber 34 is shorter than printing platen 30, i.e. one end part 24' of wall 24 is located inwardly of the end of vacuum plate 20. This permits sliding movement of the valve plate underneath the printing platen while keeping the vacuum chamber 34 enclosed.

A gap is provided in wall 24 which is aligned with a recess or cut out 18 in the wall 16 of channel member 11. A low vacuum source is connected to the vacuum chamber 34 by means of the thus formed passageway.

Each of the holes 22 through the vacuum plate is surrounded by a peripheral wall 27, of the same height as the wall 24, typically 2 to 3 mm. For reasons of clarity, only one of the holes 22 is shown in FIG. 2. Accordingly when the holes 32, 22 are aligned, the top edges of the peripheral walls 27 sealingly engage around holes 32, so that the main vacuum chamber 12 is directly connected to the upper surface of the platen 30. Thus, in operation, in the first position of the valve plate 20, FIG. 3, a high vacuum is applied through the holes 32 in the platen 30 to a print media thereon and a printing operation can occur.

Figure 4:
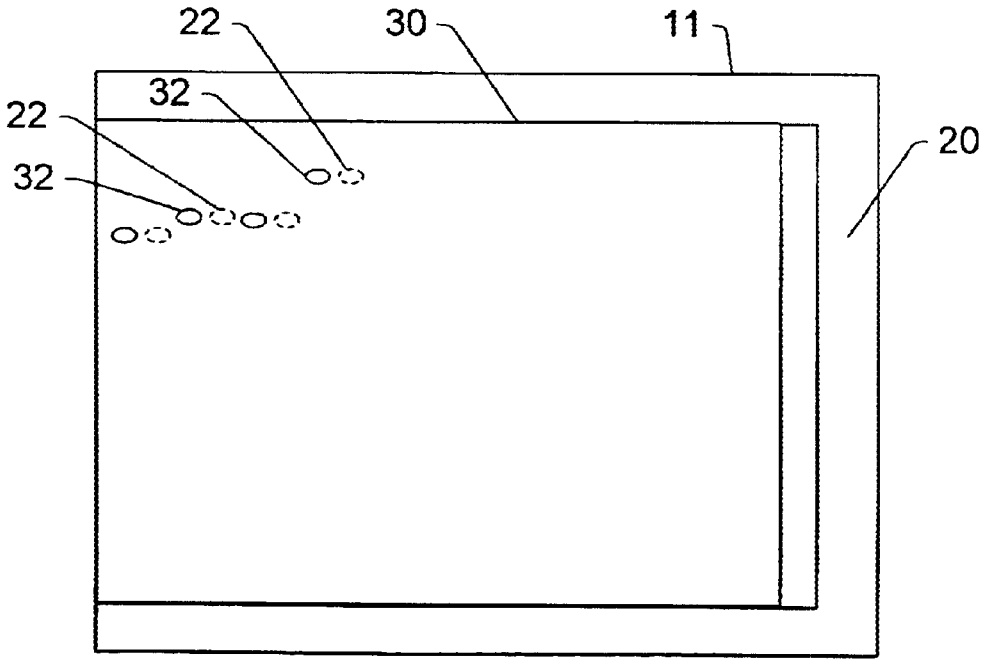
FIG. 4 is a top view similar to FIG. 3 but with the valve plate in a second position.

When holes 32, 22 are not aligned in the second position of the valve plate, FIG. 4, the holes 32 through platen 30 are instead in communication with secondary vacuum chamber 34. Thus a low vacuum is applied to the holes 32 and a media advance operation can occur. The secondary chamber 34 is sealed from the main vacuum chamber, since the top edges of walls 27 engage parts of the platen 30 where there are no holes 32.

Figure 3:
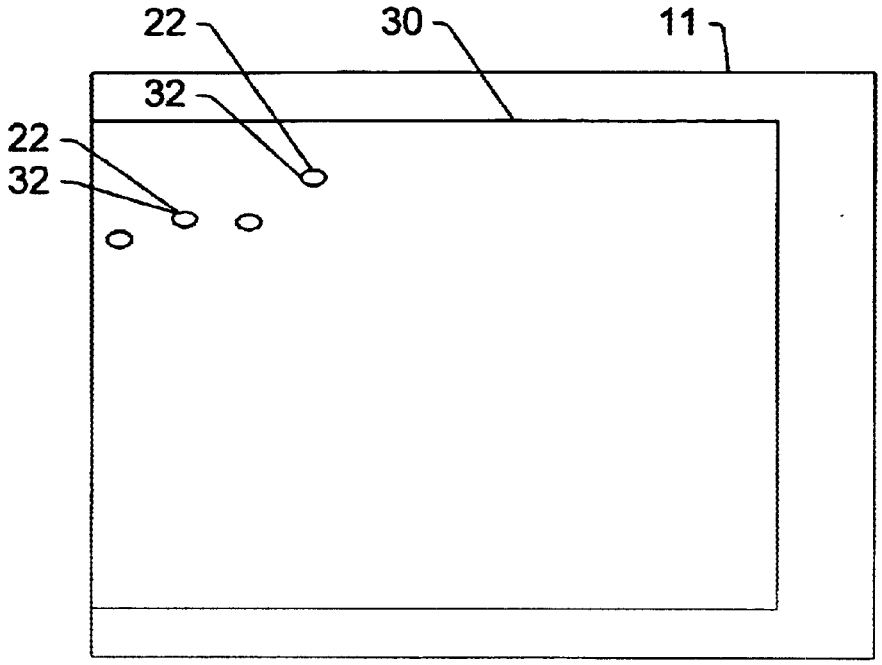
FIG. 3 is a top view of part of the device of FIG. 1, with the valve plate in a first position.

A drive means in form of a solenoid 40 (FIG. 2) is provided for linearly sliding the valve plate 20 between the positions shown in FIGS. 3 and 4. Since valve plate 20 is relatively light, it has low inertia and the switching movement can occur within a few milliseconds. Thus, in operation, the valve plate 20 pulsates or reciprocates at a high frequency between its end positions. Stop means (now shown) are provided for determining the end positions of the range of movement of the valve plate 20.

An advantage of the above-described arrangement is that the vacuum chambers 12 and 34 are much smaller than those required in prior art devices. Thus less space is required and less power is required to maintain the vacuums.

Various modifications may be made to the above-described arrangements. For example, it will be noted that wall 24 does not need to extend on all sides of plate 20. It only needs to be provided to prevent leakage into secondary chamber 34, and thus in particular at or adjacent the ends of the plate 20.

Other means may be provided to guide the linear movements of the valve plate 20; for example the walls of channel member 11 may have projections which engage in grooves in the edges of the valve plate.

The top of the valve plate 20 may be closed by a second planar portion facing planar portion 26, but leaving holes for the passageways formed by walls 27 in communication with holes 22. This increases the tightness of the chamber 34 against leaks.

Other drive means may be provided for the valve plate 20 instead of a solenoid, for example a quickly-reversible motor.

The vacuum holddown device may be used in connection with any type of printer. It may also be employed in other types of hardcopy apparatus, in particular plotters, scanners, photocopies and facsimile machines.

In a further modification, the low vacuum source can be omitted and the cut out 18 can be connected directly to the atmosphere (i.e. atmospheric pressure is applied to the underside of the print media as it advances).

Figure 5:
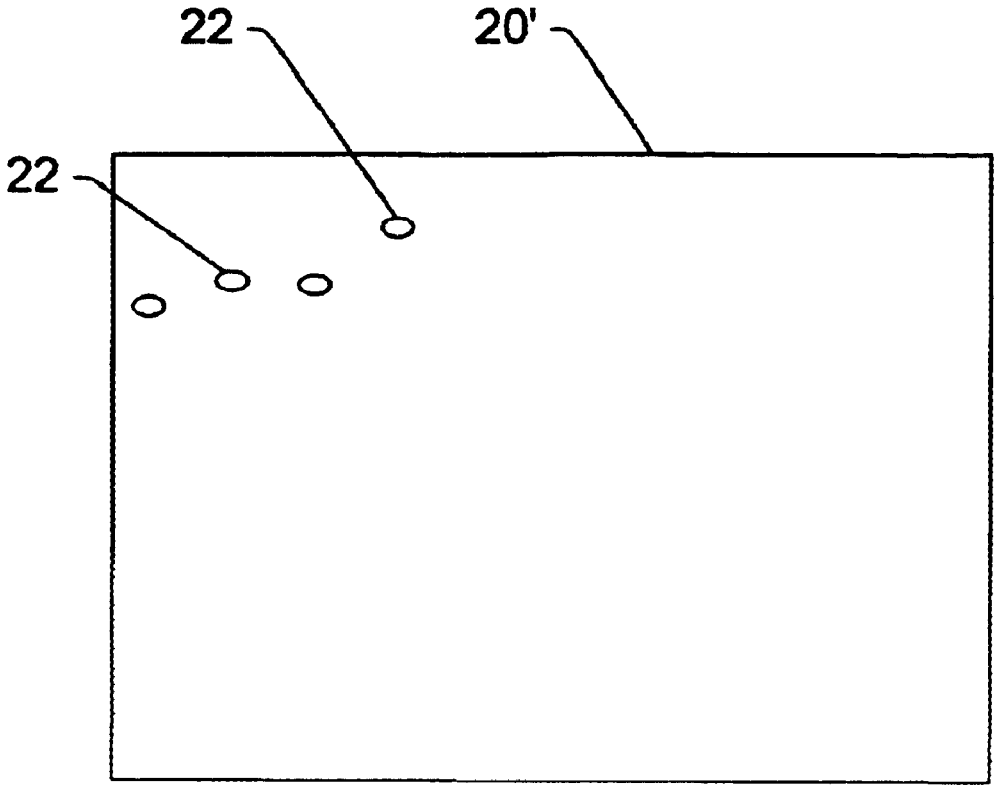
FIG. 5 is a top view of a modified valve plate.

In a further modification, in which atmospheric pressure is also applied during print media advance movements, the vacuum plate 20 is replaced by a flat shim 20', FIG. 5. Thus walls 24, 27 are omitted. Accordingly, when holes 32 and 22 are not aligned, the holes 32 are effectively sealed off. In this modification, the design of the grooves in the top surface of the platen 30 needs to be capable of applying sufficient vacuum to the media during printing, but allowing the underside of the print media to quickly attain atmospheric pressure for media advance. This inevitably involves a design compromise, so that the valve plate 20 of the embodiment of FIGS. 1 to 4 is preferred.

Although the holes 22, 32 are shown as being of generally oval shape, they can have other shapes such as circular, square or rectangular.

The vacuum plate 20 can be arranged to slide transversely of the platen instead of horizontally.

What has been described and illustrated herein is a preferred embodiment of the invention along with some of its variations. The terms, descriptions and figures used herein are set forth by way of illustration only and are not meant as limitations. Those skilled in the art will recognise that may variations are possible within the spirit and scope of the invention, which is intended to be defined by the following claims and their equivalents in which all terms are meant in their broadest reasonable sense unless otherwise indicated.

What is claimed is:

1. A vacuum holddown device for a hardcopy apparatus comprising a printing platen, said printing platen having holes therethrough, said holes being arranged in a predetermined pattern, a vacuum chamber, and a moveable member, said moveable member including a planar portion, said planar portion having holes therethrough arranged in substantially the same predetermined pattern, and said moveable member being moveable between a first position, in which said holes in said moveable member are substantially in alignment with said holes in said printing platen and said holes in said printing platen are in communication with said vacuum chamber, and a second position, in which said holes in said moveable member are out of alignment with said holes in said printing platen and said holes in said printing platen are not in communication with said vacuum chamber, wherein said planar portion of said moveable member is spaced from said printing platen and a secondary chamber is formed between said planar portion and said printing platen, said holes in said moveable member being surrounded by respective walls, said walls of said holes extending between said planar portion and said printing platen.

2. A device according to claim 1, wherein said vacuum chamber has a plurality of walls, with a recess being formed in one of said walls, said recess being in communication with said secondary chamber.

3. A device according to claim 2, wherein said moveable member includes a peripheral wall partly surrounding said planar portion, said peripheral wall extending between said planar portion and said printing platen, and said peripheral wall defining a gap located in substantial alignment with said recess in said walls of said vacuum chamber.

4. A device according to claim 2, wherein a high vacuum source is connected to said vacuum chamber, and a low vacuum source is connected to said secondary chamber via said recess.

5. A device according to claim 2, wherein a vacuum source is connected to said vacuum chamber, and said secondary chamber is subjected to atmospheric pressure via said recess.

6. A device according to claim 1, wherein said moveable member is in the form of a flat shim.

7. A device according to claim 1, comprising a solenoid drive means arranged to move said moveable member in a reciprocating manner.

8. A device according to claim 1, wherein said printing platen has an elongate shape defining a longitudinal axis and wherein said moveable member moves in the direction of said longitudinal axis.

9. A vacuum holddown device for a hardcopy apparatus comprising a printing platen, said printing platen having holes therethrough, said holes being arranged in a predetermined pattern, a vacuum chamber, and a moveable member, said moveable member including a planar portion, said planar portion having holes therethrough arranged in substantially the same predetermined pattern, and said moveable member being moveable between a first position, in which said holes in said moveable member are substantially in alignment with said holes in said printing platen and said holes in said printing platen are in communication with said vacuum chamber, and a second position, in which said holes in said moveable member are out of alignment with said holes in said printing platen and said holes in said printing platen are not in communication with said vacuum chamber, wherein the vacuum chamber has a plurality of walls, said walls defining guide means, said moveable member having edges, said edges engaging with said guide means for sliding movement relative thereto.

10. A vacuum holddown device for hardcopy apparatus comprising a printing platen having a set of through holes in a predetermined pattern, a moveable member having a set of through holes in substantially the same pattern, and a vacuum chamber, the moveable member being located between said printing platen and said vacuum chamber, wherein said moveable member includes a planar portion spaced from said printing platen and a secondary chamber is formed between said planar portion and said printing platen, said holes in said moveable member being surrounded by respective walls, said walls of said holes extending between said planar portion and said printing platen.

11. A device according to claim 10, wherein said vacuum chamber has a plurality of walls, with a recess being formed in one of said walls, said recess being in communication with said secondary chamber.

12. A device according to claim 10, wherein said vacuum chamber has a plurality of walls, with a recess being formed in one of said walls, said recess being in communication with said secondary chamber, wherein said moveable member includes a peripheral wall partly surrounding said planar portion, said peripheral wall extending between said planar portion and said printing platen, and said peripheral wall defining a gap located in substantial alignment with said recess in said walls of said vacuum chamber.

13. A device according to claim 10, wherein a high vacuum source is connected to said vacuum chamber, and a low vacuum source is connected to said secondary chamber via said recess.

14. A device according to claim 10, wherein said vacuum chamber has a plurality of walls, with a recess being formed in one of said walls, said recess being in communication with said secondary chamber, wherein a vacuum source is connected to said vacuum chamber, and said secondary chamber is subjected to atmospheric pressure via said recess.

15. A method of applying two different pressure levels to a printing platen of a vacuum holddown device of a hardcopy apparatus, said platen having a first set of through holes located to be in communication with a vacuum chamber, the method comprising providing a moveable member between said platen and said vacuum chamber, said moveable member having a second set of through holes, the holes in said first and second sets being arranged in substantially the same pattern, and the method further comprising moving said moveable member between a first position and a second position, said holes in said first and second sets being in substantial alignment in said first position wherein said first set of holes is in communication with said vacuum chamber, and said holes in said first and second sets being out of alignment in said second position wherein said first set of holes is not in communication with said vacuum chamber, wherein the vacuum chamber has a plurality of walls configured to act as guides, and said moveable member includes edges configured to engage with said guides, wherein moving said moveable member comprises moving said moveable member within said guides between said first and second positions and vice versa.

16. A method of applying two different pressure levels to a printing platen of a vacuum holddown device of a hardcopy apparatus, said platen having a first set of through holes located to be in communication with a vacuum chamber, the method comprising providing a moveable member between said platen and said vacuum chamber, said moveable member having a second set of through holes, the holes in said first and second sets being arranged in substantially the same pattern, and the method further comprising moving said moveable member between a first position and a second position, said holes in said first and second sets being in substantial alignment in said first position wherein said first set of holes is in communication with said vacuum chamber, and said holes in said first and second sets being out of alignment in said second position wherein said first set of holes is not in communication with said vacuum chamber, wherein moving said movable member is in response to switching between a printing phase a media advance phase.

17. A process for operating a vacuum holddown device for a hardcopy apparatus including a printing platen having a first set of through holes in a predetermined pattern, a moveable member having a second set of through holes in substantially the same pattern, and a vacuum chamber, the moveable member being located between said printing platen and said vacuum chamber, wherein the vacuum chamber has a plurality of walls configured to act as guides, and said moveable member includes edges configured to engage with said guides, the process comprising moving said moveable member within said guides between a first position and a second position, said holes in said first and second sets being in substantial registration in said first position wherein said first set of holes is in communication with said vacuum chamber, and said holes in said first and second sets being out of registration in said second position wherein said first set of holes is not in communication with said vacuum chamber.

18. The process of claim 17, wherein moving said movable member is in response to switching between a printing phase a media advance phase.

19. A process for operating a vacuum holddown device for a hardcopy apparatus including a printing platen having a first set of through holes in a predetermined pattern, a moveable member having a second set of through holes in substantially the same pattern, and a vacuum chamber, the moveable member being located between said printing platen and said vacuum chamber, the process comprising moving said moveable member between a first position and a second position in response to switching between a printing phase a media advance phase, said holes in said first and second sets being in substantial registration in said first position wherein said first set of holes is in communication with said vacuum chamber and communicating a high vacuum in said first position, and said holes in said first and second sets being out of registration in said second position and said first holes not communicating a high vacuum when said moveable member is in said second position.

20. The process of claim 19, wherein the vacuum chamber has a plurality of walls configured to act as guides, and said moveable member includes edges configured to engage with said guides and moving comprises moving said moveable member within said guides between said first and second positions.

21. A vacuum holddown device for a hardcopy apparatus comprising a printing platen, said printing platen having holes therethrough, said holes being arranged in a predetermined pattern, a vacuum chamber, and a moveable member, said moveable member including a planar portion, said planar portion having holes therethrough arranged in the same predetermined pattern, and said moveable member being moveable between a first position, in which said holes in said moveable member are in alignment with said holes in said printing platen and said holes in said printing platen are in communication with said vacuum chamber, and a second position, in which said holes in said moveable member are out of alignment with said holes in said printing platen and said holes in said printing platen are not in communication with said vacuum chamber.

22. A vacuum holddown device for a hardcopy apparatus comprising a printing platen, said printing platen having holes therethrough, said holes being arranged in a predetermined pattern, a vacuum chamber, and a moveable member in direct contact with said printing platen, said moveable member including a planar portion, said planar portion having holes therethrough arranged in substantially the same predetermined pattern, and said moveable member being moveable between a first position, in which said holes in said moveable member are substantially in alignment with said holes in said printing platen and said holes in said printing platen are in communication with said vacuum chamber, and a second position, in which said holes in said moveable member are out of alignment with said holes in said printing platen and said holes in said printing platen are not in communication with said vacuum chamber.

23. A vacuum holddown device for hardcopy apparatus comprising a printing platen having a set of through holes in a predetermined pattern, a slideable member having a set of through holes in substantially the same pattern, and a vacuum chamber, the moveable member being located between said printing platen and said vacuum chamber and being configured to move in a sliding manner.

24. The holddown device of claim 23, wherein the vacuum chamber has a plurality of walls, said walls defining guides, said moveable member having edges, said edges engaging with said guides for sliding movement relative thereto.

25. A method of applying two different pressure levels to a printing platen of a vacuum holddown device of a hardcopy apparatus, said platen having a first set of through holes located to be in communication with a vacuum chamber, the method comprising providing a moveable member between said platen and said vacuum chamber, said moveable member having a second set of through holes, the holes in said first and second sets being arranged in the same pattern, and the method further comprising moving said moveable member between a first position and a second position, said holes in said first and second sets being in substantial alignment in said first position wherein said first set of holes is in communication with said vacuum chamber, and said holes in said first and second sets being out of alignment in said second position wherein said first set of holes is not in communication with said vacuum chamber.

26. A method of applying two different pressure levels to a printing platen of a vacuum holddown device of a hardcopy apparatus, said platen having a first set of through holes located to be in communication with a vacuum chamber, the method comprising providing a moveable member between said platen and said vacuum chamber and in direct contact with said platen, said moveable member having a second set of through holes, the holes in said first and second sets being arranged in substantially the same pattern, and the method further comprising moving said moveable member between a first position and a second position, said holes in said first and second sets being in substantial alignment in said first position wherein said first set of holes is in communication with said vacuum chamber, and said holes in said first and second sets being out of alignment in said second position wherein said first set of holes is not in communication with said vacuum chamber.

* * * * *